US010159625B2

(12) United States Patent
Sowden et al.

(10) Patent No.: US 10,159,625 B2
(45) Date of Patent: Dec. 25, 2018

(54) PACKAGE WITH A FULCRUM AND A LEVER ARM

(71) Applicant: JOHNSON & JOHNSON CONSUMER INC., Skillman, NJ (US)

(72) Inventors: Harry S. Sowden, Glenside, PA (US); Gerard P. McNally, Berwyn, PA (US); R. Scott Shorts, Hatfield, PA (US)

(73) Assignee: Johnson & Johnson Consumer Inc., Skillman, NJ (US)

( * ) Notice: Subject to any disclaimer, the term of this patent is extended or adjusted under 35 U.S.C. 154(b) by 623 days.

(21) Appl. No.: 14/282,986

(22) Filed: May 20, 2014

(65) Prior Publication Data

US 2014/0346081 A1 Nov. 27, 2014

Related U.S. Application Data

(60) Provisional application No. 61/825,652, filed on May 21, 2013, provisional application No. 61/825,704,
(Continued)

(51) Int. Cl.

| | |
|---|---|
| ***B65D 73/00*** | (2006.01) |
| ***B65D 75/58*** | (2006.01) |
| ***B65D 83/04*** | (2006.01) |
| ***B65D 75/32*** | (2006.01) |

(Continued)

(52) U.S. Cl.
CPC ..... *A61J 1/035* (2013.01); *B65D 77/2052* (2013.01); *B65D 2215/04* (2013.01);
(Continued)

(58) Field of Classification Search
CPC ..... B65D 2585/56; B65D 2575/3236; B65D 2575/3245; B65D 75/58; B65D 75/5816;
(Continued)

(56) References Cited

U.S. PATENT DOCUMENTS 3,630,346 A * 12/1971 Burnside ..... B65D 75/32 206/445
3,689,458 A * 9/1972 Hellstrom ..... B65D 75/32 206/530

(Continued)

FOREIGN PATENT DOCUMENTS

CH 677473 A5 5/1991

OTHER PUBLICATIONS

Oxford English Dictionary—Accessed Online at http://www.oed.com/view/Entry/75290?redirectedFrom=Fulcrum&print Entry for 'Fulcrum'.*

(Continued)

*Primary Examiner* — J. Gregory Pickett
*Assistant Examiner* — Gideon Weinerth

(57) ABSTRACT

A package including a container and a cover sheet, the container having a first section and a second section connected at a breakable joint, the first section includes a well, and the cover sheet is adhered to at least a portion of the first section and at least a portion of the second section and the cover sheet covers the well. Either the first section or the second section is adapted to pivot to assist in breaking the breakable joint in order to separate the first section and the second section, and allow removal of the cover sheet.

20 Claims, 14 Drawing Sheets

Related U.S. Application Data filed on May 21, 2013, provisional application No. 61/825,740, filed on May 21, 2013, provisional application No. 61/825,660, filed on May 21, 2013, provisional application No. 61/825,691, filed on May 21, 2013, provisional application No. 61/825,669, filed on May 21, 2013.

(51) Int. Cl.
*A61J 1/03* (2006.01)
*B65D 77/20* (2006.01)

(52) U.S. Cl.
CPC .. *B65D 2215/08* (2013.01); *B65D 2575/3236* (2013.01); *B65D 2577/2083* (2013.01)

(58) Field of Classification Search
CPC .. B65D 75/5855; B65D 75/26; B65D 75/527; B65D 75/327; B65D 2215/04; B65D 2575/367; B65D 2575/362
USPC ..... 206/530, 469, 484, 820, 807, 539, 532, 206/461; 220/359.2, 359.1; 222/541.6, 222/107
See application file for complete search history.

(56) References Cited

U.S. PATENT DOCUMENTS 3,809,220 A 5/1974 Arcudi
3,835,995 A * 9/1974 Haines ..... B65D 75/327 206/469
3,921,805 A * 11/1975 Compere ..... B65D 75/327 206/469
4,371,080 A 2/1983 Haines
5,511,665 A 4/1996 Dressel et al.
5,529,188 A 6/1996 Coggswell
5,727,687 A * 3/1998 Renner ..... B65D 75/327 206/532
5,775,505 A * 7/1998 Vasquez ..... B65D 75/327 206/532
5,890,596 A * 4/1999 Albisetti ..... B65D 81/3294 206/557
6,036,016 A 3/2000 Arnold
6,155,423 A * 12/2000 Katzner ..... B65D 75/327 206/469
6,422,391 B1 7/2002 Swartz
7,422,125 B2 * 9/2008 Winberg ..... B65D 75/327 206/469
7,770,732 B2 * 8/2010 Stroppolo ..... B65D 75/32 206/528
8,191,711 B2 * 6/2012 Nivala ..... B65D 75/327 206/528
8,333,280 B2 * 12/2012 Le ..... B65D 83/0463 206/1.5

OTHER PUBLICATIONS

International Search report dated Sep. 29, 2014 for PCT/US2014/038842.

* cited by examiner

PACKAGE WITH A FULCRUM AND A LEVER ARM

CROSS-REFERENCE TO RELATED APPLICATIONS

This application claims priority of the benefits of the filing of U.S. Provisional Application Ser. No. 61/825,652, filed May 21, 2013; U.S. Provisional Application Ser. No. 61/825,704, filed May 21, 2013; U.S. Provisional Application Ser. No. 61/825,740, filed May 21, 2013; U.S. Provisional Application Ser. No. 61/825,660, filed May 21, 2013; U.S. Provisional Application Ser. No. 61/825,691, filed May 21, 2013; and U.S. Provisional Application Ser. No. 61/825,669, filed May 21, 2013; the contents of each of which are hereby incorporated by reference in their entirety.

BACKGROUND OF THE INVENTION

Field of the Invention

The present invention relates to packaging for products. More particularly, the present invention relates to tamper and child resistant packaging for pharmaceutical and/or consumer products.

Background

Product packaging comes in many forms and shapes. A wide variety of blister packages for packaging a variety of consumer products are available in the art. These blister packages typically are formed of a transparent layer (the "blister") coupled (preferably sealed or otherwise bonded) to a backing layer. The blister has a well or cavity or other type of deformation formed therein such that upon coupling of the blister to the backing layer a compartment or pouch is formed for holding or containing a desired product. The product well(s) may be accessed by stripping the backing layer from the package to expose the well and the product therein, or to expose a rupturable/push-through backing layer below the well through which the product may be pushed upon exerting pressure on the blister and the article (a "peel-and-push" blister package). Alternatively, the well(s) may be accessed by tearing the edge of the package toward such well(s) (a "tear-access" blister package). A starting notch or slit may be provided to facilitate tearing.

For pharmaceutical and drug packaging, blister packaging for dosing individual units or unit doses is often used. This type of packaging is also designed to provide child resistance or childproofing to prevent children from easily accessing the medicament/product held inside. However, the packaging must also be designed to allow adults access to the medicament contained within.

One common use of blister packages is for packaging solid-dose medications or pharmaceuticals (e.g., tablets, capsules, caplets, and the like; hereinafter "medications" for the sake of convenience and with no intent to limit) or consumer products. Such packaging typically is desirable for carrying individual/unit doses of medication, and may afford a greater level of portability than other types of packaging (e.g., bottles). Like typical blister packages, blister packages for medications generally permit moderately easy viewing of the contents therein. Such easy viewing may tempt a small child to try to access the product. The Consumer Product Safety Commission has established rules governing which products require special packaging and standards for such special packaging in the Poison Prevention Packaging Act of 1970, outlined in the Code of Federal Regulations, Title 16, Part 1700. "Special packaging," commonly referenced as child-resistant or CR packaging, is defined in 16 C.F.R. sctn.1700.1 (b)(4) as "packaging that is designed or constructed to be significantly difficult for children under 5 years of age to open or obtain a toxic or harmful amount of substance contained therein within a reasonable time and not difficult for normal adults to use properly, but does not mean packaging which all such children cannot open or obtain a toxic or harmful amount within a reasonable time." Products requiring special packaging include all prescription medications and over-the-counter medications, and a variety of other substances that are harmful if handled, used, or ingested. Child resistant blister packages are also desirable for packaging any other type of article that is unsafe for a child, such as medical instruments, sharp objects, or addictive substances (e.g., caffeine, nicotine, etc.).

A variety of manners of forming a child-resistant blister package are known in the art. For instance, a peel-and-push type blister package generally requires sufficient cognitive skills to render the package child-resistant. Tear-access type blister packages may be formed of a tear-resistant material that is nearly impossible to tear unless the material is weakened (such as by perforations) and a minimum amount of force, generally greater than within the capacity of a child, is used. Child-resistant blister packages must, however, take into account the needs of the adults who are to access its contents. In particular, the child-resistant blister package should be designed to permit senior and physically disabled adults to open the package readily. If the tear resistance of a child-resistant tear-access blister package is reduced for ready opening by a senior or physically disabled adult, then there is a risk that a child may open such package as well.

Additional features (e.g., requiring folding, tearing, or stripping to gain access to the content of the product well) may be required to add a further step beyond the cognitive skills of small children. Thus, a high tear resistance may not be necessary for a tear-access blister package to still qualify as child resistant. For instance, a tear-initiating notch (generally required in tear-resistant blister packages for initiating a tear) may be inaccessible unless the blister card is folded over, such as disclosed in U.S. Pat. No. 3,809,220 to Arcudi and U.S. Pat. No. 5,511,665 to Dressel et al. Alternatively, a portion of the blister card may have to be removed first in order to permit tearing of the package to access the contents of the blister, as disclosed in U.S. Pat. No. 6,422,391 to Swartz. The requirement of tearing at a particular location on the blister package also elevates the cognitive skills required to open the package, such as requiring initial tearing through a peripheral tearing blister, as disclosed in U.S. Pat. No. 6,036,016 to Arnold. Another added step elevating the cognitive skills required to open the blister package beyond those of a typical child may be to require manipulation of the medication in the blister before rupturing the blister package to access the medication, such as disclosed in U.S. Pat. No. 4,371,080 to Haines and U.S. Pat. No. 5,529,188 to Coggswell.

There remains a continuing desire in the industry to improve the child-resistant features of tear-access blister packages to improve consumer friendliness and ease of opening for adults, including senior and physically disabled adults.

SUMMARY OF THE INVENTION

The present invention is directed to a package comprising a container having a first section and a second section connected at a breakable joint, wherein the first section comprises a well; and a cover sheet, wherein the cover sheet is adhered to at least a portion of the first section and at least a portion of the second section and the cover sheet covers the well; wherein either the first section or the second section is adapted to pivot at a fulcrum between the cover sheet and the joint to assist in breaking the breakable joint in order to separate the first section and the second section, such that upon the breaking, the first section and the second section are still adhered to the cover sheet and wherein the second section serves as a grip to remove the sheet from the first section to expose the well.

The present invention is also directed to a card comprising at least one package, wherein the package comprises a container having a first section and a second section connected at a breakable joint, wherein the first section comprises a well; and a cover sheet, wherein the cover sheet is adhered to at least a portion of the first section and at least a portion of the second section and the cover sheet covers the well; wherein either the first section or the second section is adapted to pivot at a fulcrum between the cover sheet and the joint to assist in breaking the breakable joint in order to separate the first section and the second section, such that upon the breaking, the first section and the second section are still adhered to the cover sheet and wherein the second section serves as a grip to remove the sheet from the first section to expose the well.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
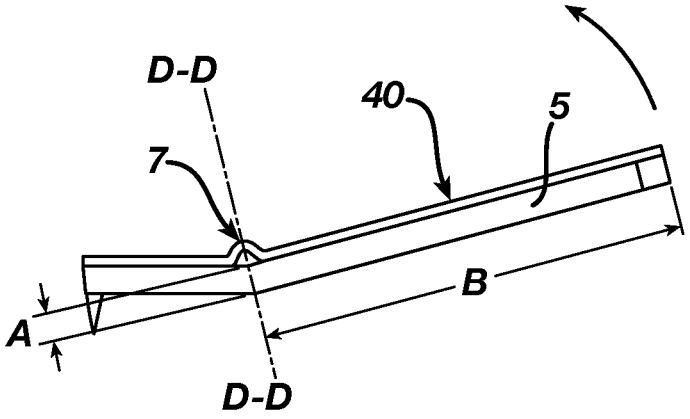
FIG. 1 illustrates a lever arm as it starts to bend.

The present invention provides a package that is particularly suitable for limited access or child-resistant applications, although the package of the present invention need not necessarily rise to the level of an approved "child-resistant" package. The child-resistant features of the package of the present invention rely on requiring a level of cognitive skills to open the package beyond those of a child (at least of the age specified in Title 16 of the C.F.R., Part 1700) yet are well within those of senior or physically disabled adults.

A package formed in accordance with the principles of the present invention requires multiple steps in order to access the product contained within the well, yet preferably does not require a high degree of force or strength to be opened. In one embodiment, the package of the invention is opened by applying a force sufficient to break a breakable joint, which enables the cover sheet sealed to at least a portion of the package to be removed. Without breaking the breakable joint, the cover sheet is difficult to remove by any user. The additional step of breaking the breakable joint creates a greater level of complexity, which makes the package more child-resistant.

The present invention is directed to a package comprising a container and a cover sheet. The container desirably has a first section and a second section connected at a breakable joint, wherein the first section comprises a well. The cover sheet is adhered to at least a portion of the first section and at least a portion of the second section and the cover sheet covers the well. The cover sheet may be adhered to the first and/or second sections in such a fashion that it cannot be removed without taking further action, e.g., the cover sheet may be perimeter sealed about the first and second sections. In this embodiment, either the first section or the second section is adapted to pivot at a point of engagement (referred to herein as a "fulcrum") between the first and second sections to assist in breaking the breakable joint in order to separate the first section and the second section. Further, upon the breaking, the first section and the second section are still adhered to the cover sheet, and the second section serves as a grip to remove the sheet from the first section to expose the well.

The container includes a first section and a second section that are connected by a breakable joint. In one embodiment, a portion of the first section extends beyond the plane of the breakable joint to be within or outside the periphery of the second section. In another embodiment, a portion of the second section extends beyond the plane of the breakable joint to be within or outside the periphery of the first section.

The container may be manufacture with a rigid or semi-rigid material. Suitable materials include, but are not limited to, polypropylene, polyethylene, high density polyethylene (HDPE), polyvinyl chloride, polyvinylidene chloride (PVDC), fluorinated-chlorinated resin, fluoropolymer, and mixtures thereof. In one embodiment, the container is desirably made of recyclable material.

The physical properties of these materials are ideally suited for use in the package of the invention. For example, polypropylene (PP) and high density polyethylene (HDPE) are materials that are very strong in tension and compression, but are somewhat weak when shear forces are applied. They are not brittle and will not crack as easily as polyvinyl chloride (PVC), although materials such as PVC may be used as desired. In addition, additives may be added to enhance desired properties or characteristics of the material. Suitable additives include, for example, colorants/tints, clarifiers, UV stabilizers/inhibitors/blockers, oxygen scavengers, desiccants, and antimicrobials. In addition, fluorination agents to prevent chemical permeation, weight loss, odor emission and flavor or fragrance loss may be added to the semi-rigid material.

In the present invention, the first section or second section of the container functions as a lever, which pivots about a point of engagement disposed between sidewalls of the first and second sections (the "fulcrum"). The fulcrum is basically a fixed support or point where a wall of the first section is in contact with a wall of the second section. The force arm is the part of the lever to which some kind of force is applied. The force arm is defined as the distance from the fulcrum to the point where force is applied. The resistance arm is the part that moves against a resistance. the resistance arm is defined as the distance from the fulcrum to the point where the resistance is concentrated, e.g., the breakable joint.

The first section of the container includes a well for holding the product. Optionally, the well may be surrounded by a lip.

The well holds a product and protects the product. The well may be shaped to conform to the product that it is intended to hold. In one preferred embodiment, the well has a circular shape. In another preferred embodiment, the well is designed to hold a medicament. The well may also be designed to provide or deliver a unit dose of a medicament. The well may have sufficient strength to securely house a component without risk of crushing or breaking through packaging, delivery and ultimate use of the product by a user.

Figure 19:
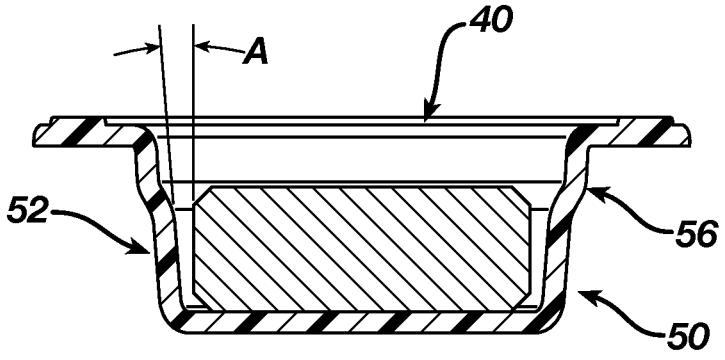
FIG. 19 illustrates a side view of a well.

For added protection, the well may be designed with an angle along the interior of the well sidewalls to securely hold the product in the well, allowing little or substantially no movement of the product. In the embodiment shown in FIG. 19, for example, a majority of side wall 52 of well 50 is at an angle of from about 0° to about 20° with respect to a line perpendicular to the plane of cover sheet 40. Preferably, the angle of side wall 52 is from about 0° to about 10°, and more preferably, from about 0° to about 5° with respect to a line perpendicular to the plane of cover sheet 40.

The container may be designed and manufactured according to the needs and purpose of the package. For example, the container may have a uniform thickness throughout the package. Or the container may be made with varying thickness in different portions of the package. In one embodiment, the well 50 has a side wall 52 and a bottom 54, where the thickness of the bottom 54 is greater than the thickness of the sidewall 52. See FIG. 20. In another embodiment, the thickness of the bottom 54 of the well 50 is greater than 80% of the thickness of the side wall 52.

Figure 20:
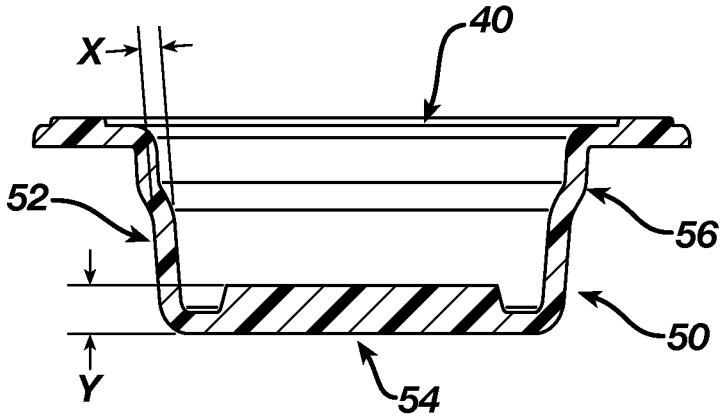
FIG. 20 illustrates another embodiment of a side view of a well.
Figure 21:
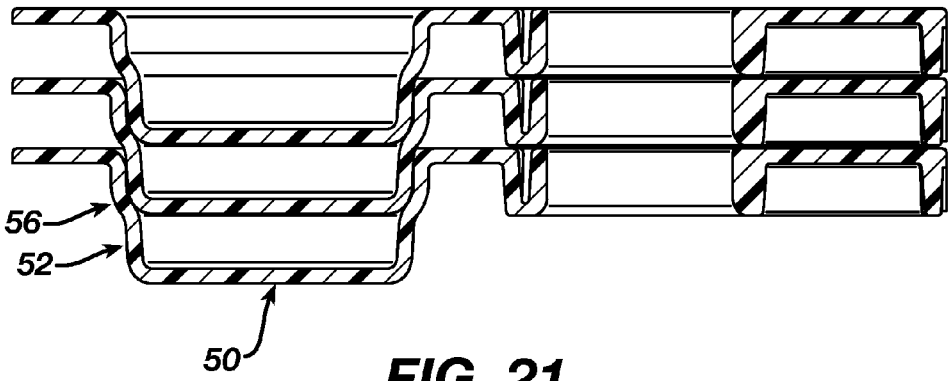
FIG. 21 depicts packages stacked one on another.

In one embodiment as can be seen in FIGS. 20 and 21, a step 56 along the sidewall 52 may be added to strengthen the well 50, thus increasing the crush resistance strength of the well 50. In addition, the inclusion of step 56 along the sidewall 52 of the well 50 enables the package to be stacked one over the other. The ability to stack multiple packages, especially when the package is manufactured in a card configuration where multiple packages are linked together, e.g., 2 by 4 configuration (for a total of 8 individual packages), may be a useful feature for storage purposes or manufacturing purposes. See FIG. 21.

Optionally, the container may have one or more wells, i.e., multiple wells.

The cover sheet covers the well and is typically sealed to the well itself, the container, and/or a lip that may surround the well. An adhesive and/or heat treatment (e.g., heat sealing) is used to seal the cover sheet to the container. The cover sheet is preferably formed from a rupture and puncture resistant material, such as a tear-resistant lamination. Preferably, the material of the cover sheet is selected to be compatible with the material of the container, such as for heat sealability. Additionally, as with the container, the cover sheet must be compatible with the product to be contained within the well. Barrier properties, UV protection, and other characteristics (such as, but not limited to, those that would contribute to stability of the product) may be important considerations in selecting the material of the cover sheet. Suitable materials include, for example, PET, a PET foil lamination, or some other lamination of oriented polypropylene. If desired, the cover sheet material may be substantially rigid to retain the overall stiffness of the package.

Additionally, the cover sheet may be formed of a flexible material, a rigid material, or a textured material. Tearability of the cover sheet may factor into what material is selected for the cover sheet. Generally, to have a degree of child-resistance, the material of the cover sheet is selected to be at least somewhat tear-resistant. The degree of tear resistancy is based on the level of child-resistancy desired or necessary for the package. The sealing of the container to the cover sheet may together further strengthen the overall tear-resistance of the package.

The cover sheet covers and seals at least a portion of the top surface of the container. For example, the cover sheet covers and seals at least about 20% of the surface of the container is covered and sealed. Preferably, at least about 30%, more preferably at least 50%, and even more preferably, at least 60% of the surface of the container is covered and sealed.

In one embodiment, the cover sheet is sealed around the perimeter of at least a portion of the container. In another embodiment, the cover sheet is sealed around at least a portion of the perimeter of the well. It may be particularly desired that the cover sheet be sealed in such a fashion that there is no loose ends or flaps of cover sheet that may be accessible to a user, thereby requiring breakage of the breakable joint to peel the cover sheet.

In pharmaceutical or drug packaging, the cover sheet may include a first layer of white polyester, a second layer of adhesive, a third layer of foil, and a fourth layer of heat seal. As discussed previously, the cover sheet should be strong and provide excellent child resistance.

In some applications, the cover sheet may include features or materials such as a heat sealable layer, aluminum foil, adhesive/bonding layers, primer, polyester, paper, metalized film, polyethylene, ink, polyvinyl chloride (PVC), polypropylene (PP), bi-axially oriented polypropylene (BOPP), ethylene vinyl alcohol (EVOH), and combinations thereof.

Reference will now be made to the Figures, which provide a greater understanding of the various embodiments of the present invention.

FIG. 1 depicts the basic concept of a fulcrum lever arm of the present invention. In FIG. 1 a surface 5 of a package with a cover sheet 40 on a top portion of the surface 5 is being bent. The bending results in the cover sheet 40 (e.g., lidstock) buckling, crumpling, or puckering at the point of bending 7. Due to the strength and adherence of the cover sheet, if the cover sheet were to pucker downward, the package would not open properly. As the cut geometry closes up and the edges meet (e.g., bending of a tab element), a fulcrum line D-D is created. Bending further increases the lever action about the fulcrum line D-D until the tension increases to the point of rupturing a breakable joint. This is the force that breaks the breakable joint which connects the first section and the second section. The mechanical advantage that is created to rupture the frangible element/zone is defined by the ratio of dimension "B" divided by "A" where "A" is the distance from the fulcrum to the distal point of the breakable joint and "B" is the length of the lever applied against the fulcrum. Thus, this lever ratio is one measurement of force needed to open the package and is a force multiplier. A typical human being would not be strong enough to open a package without first applying force to sever a breakable joint. This may be adjusted or tuned as desired. The lower the ratio, the more difficult it is to open. Conversely, the higher the ratio, the easier it is to open. In the present invention, the lever ratio is the distance from the fulcrum to a distal point of the breakable joint compared to the length of a lever defined by the first section or the second section. In one embodiment, lever ratio is at or greater than about 1:1. In another embodiment, the lever ratio is at or greater than about 2:1. In yet another embodiment, the lever ratio is at or greater than about 4:1. In still another embodiment, the lever ratio is at or greater than about 6:1. The mechanical advantage/lever ratio of the fulcrum lever arm may be adjusted to provide a desired level of resistance for making the package child resistant.

In another embodiment, the distance from the breakable joint to the fulcrum is at least five times less than the distance from the distal point of the second section from the joint.

Figure 2:
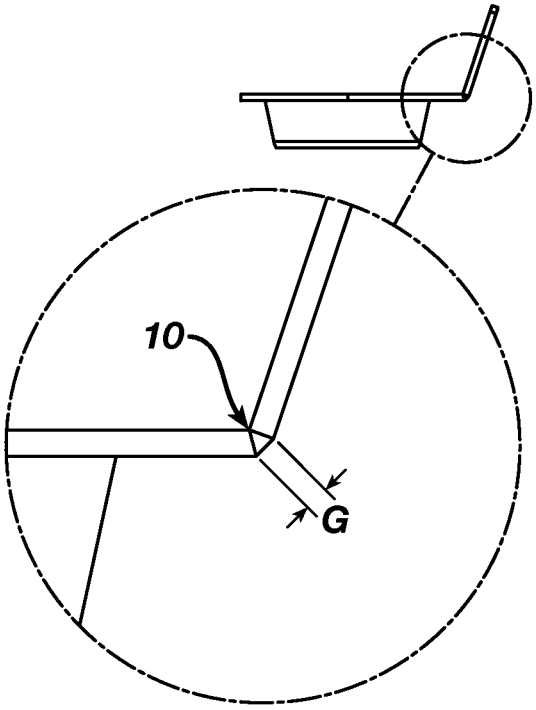
FIG. 2 illustrates a lever arm more fully bent.

FIG. 2 depicts a breakable joint wherein the leverage ratio was insufficient, resulting in a joint that is stretched but not broken. In this figure, a leverage ratio is selected to be greater than a stretch-break dimension "Q." Surface 5 of a package is bent upward, and the point of contact (fulcrum) between first section and second section can be seen at fulcrum 10. In so doing, failure to choose a proper leverage ratio leads to a package that will not open. In such a situation, the stretch "Q" of the polymer causes the tab to bend too far. In this depiction, the leverage ratio is driven by the substrate thickness "T." Polymers such as PP and HDPE are very elastic before rupturing under tensile forces. These polymer materials will significantly stretch before the material breaks. This implies that "Q" will be rather large and that the force required to break the joint must be considered.

Figure 3A:
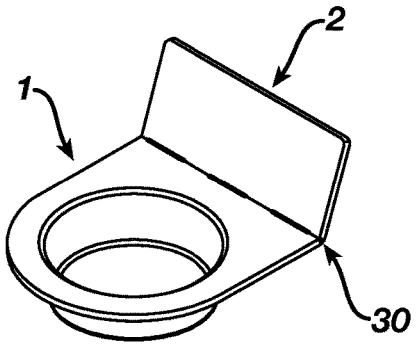
FIG. 3A and FIG. 3B illustrate a basic embodiment of a container with a breakable joint.
Figure 3B:
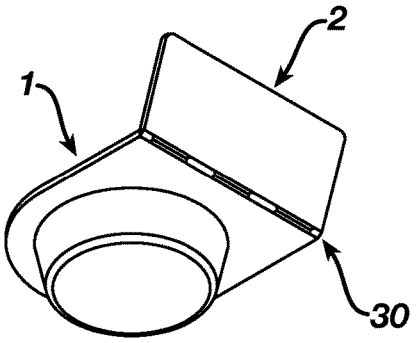
Figure 4:
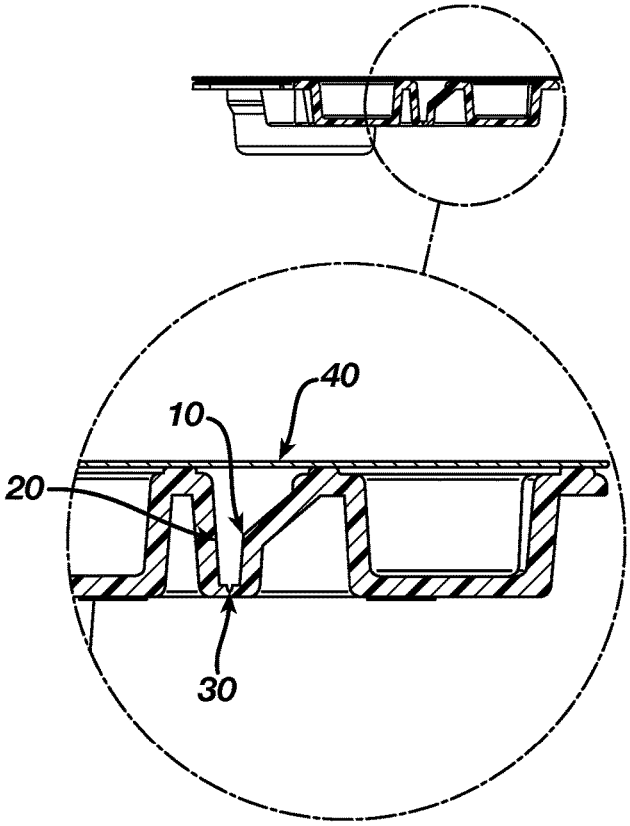
FIG. 4 illustrates a lever arm and a fulcrum as part of a package.

FIGS. 3A and 3B show one embodiment of a container having a breakable joint 30 connecting a first section 1 and second section 2. As can be seen, breakable joint 30 may include regions where there is no connection between the two sections and regions where there is a connection between the two sections. In FIG. 4, lever arm 20, fulcrum 10, breakable joint 30 and cover sheet 40 are shown. Lever arm 20 and fulcrum 10 are located between breakable joint 30 and cover sheet 40 in a package. In use, the fulcrum 10 acts as a fulcrum when it comes into contact with lever 20 and force is enacted on the lever 20. As can be seen, fulcrum 10 is any configuration that results in first section 1 and second section 2 coming into contact with each other at a defined point or line.

As described above, one feature of the present invention includes a breakable joint 30, which connects the first section 1 and the second section 2. The breakable joint 30 is a weakened area that breaks when sufficient force is applied against the joint 30. To break the joint 30, the first and/or second sections (1, 2) are moved in an angle toward each other such that the joint 30 is pulled apart. Sufficient pulling forces applied against the breakable joint 30 will pull the joint apart. The force required to break the breakable joint 30 may be adjusted by scoring, notching, or perforating the breakable joint 30. Alternatively, the breakable joint 30 may be formed having (i) a specified thickness and/or shape, and/or (ii) at least one point of attachment (preferably at least two points), which affects the force needed to break the breakable joint 30. In one embodiment, the breakable joint 30 may be notched to have a pointed "V" pointing away from the cover sheet 40 or lid material. In one embodiment, the joint 30 breaks due to the excessive tensile forces applied to the breakable joint 30.

As can be seen in FIG. 4, the cover sheet 40 extends between first section 1 and second section 2 at a surface opposite the breakable joint 30. Therefore, due to the tensile and tear strength of the cover sheet 40, a user will have difficulty bending the first and second sections in an opposite direction than that required to break the joint 30.

Figure 5:
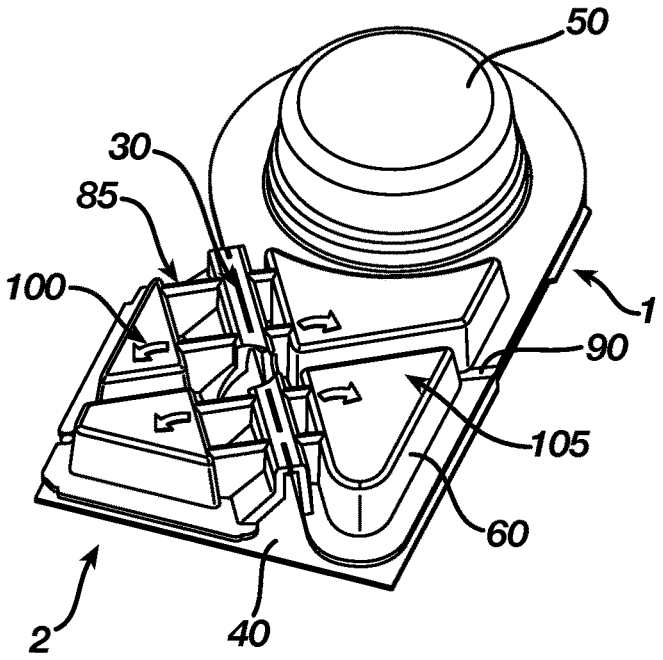
FIG. 5 is a top view of an embodiment of the invention.

FIG. 5 is a bottom perspective view of one embodiment of the inventive package, where first section 1 of the package has spoon shaped configuration, including well 50 and handle 60. Second section 2 of the package is connected to first section 1 by breakable joint 30. In the embodiment shown, first section 1 and second section 2 are attached to cover sheet 40. Second section 2 includes optional ribs 85. In one embodiment, handle 60 includes one or more wells or cavities which are capable of housing a product. Noticeably, the shape of the first section 1 resembles a spoon, which may be used by a user to aid in delivery of the medicament without having to first take the medicament out of the well by hand.

Figure 6A:
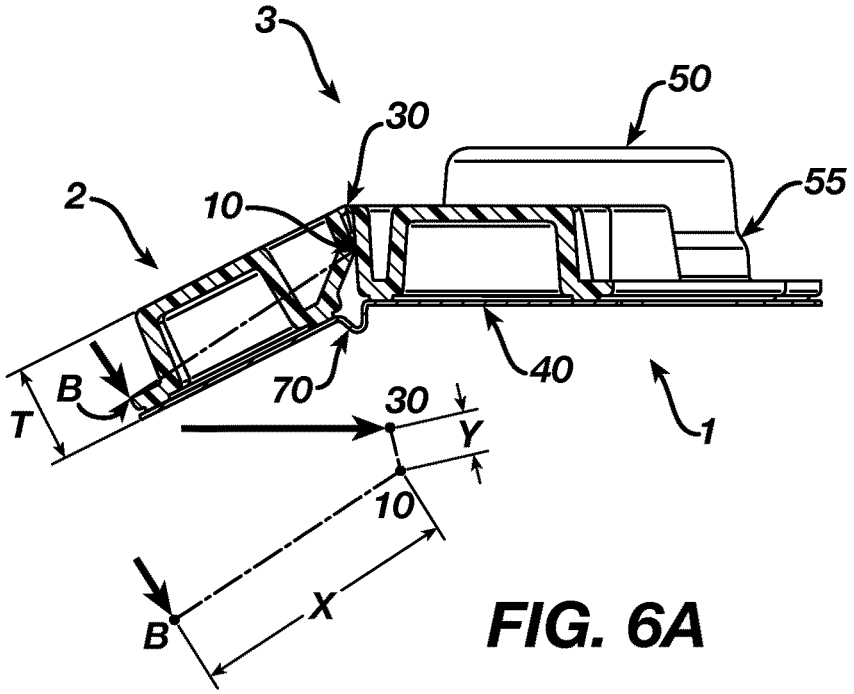
FIG. 6A and FIG. 6B show a side view of a package having a point of contact which may be used to break a breakable joint.
Figure 6B:
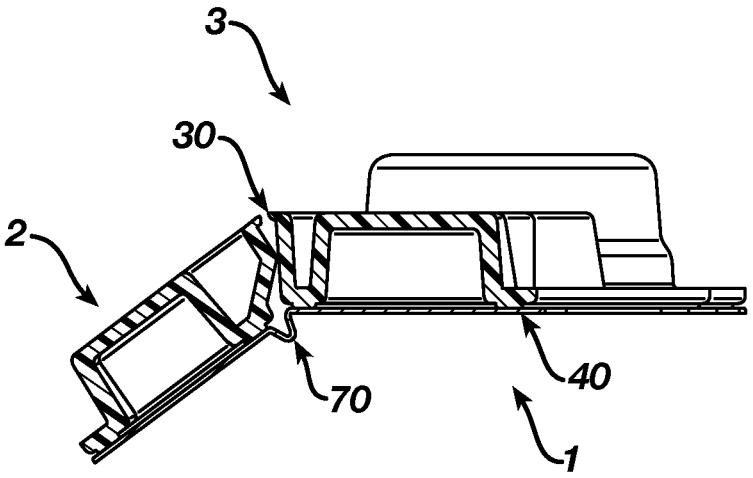

FIG. 6A shows a side view of a package depicting an embodiment of the invention, where a second section 2 of a package is bent in a direction perpendicular to breakable joint 30, which connects second section 2 to first section 1 of the package. As can be seen, there is a gap between the breakable joint 30 and the cover sheet 40, which allows movement of the first and second sections (1, 2) in only one direction (e.g., in a direction such that the fulcrum 10 is formed by engaging the first section 1 and second section 2). It is noted that during the "breaking" step, there is a point of engagement between the first section 1 and second section 2 at the fulcrum 10. In FIG. 6B, second section 2 has been moved with sufficient force to break breakable joint 30. The joint breaks, (e.g., pulls apart) due to the excessive force applied to the breakable joint as a result of the lever and fulcrum 10.

Another aspect of the invention is that the tensile strength of the cover sheet, e.g., mylar laminate lid structure, allows the package to be bent in only one direction.

Figure 7:
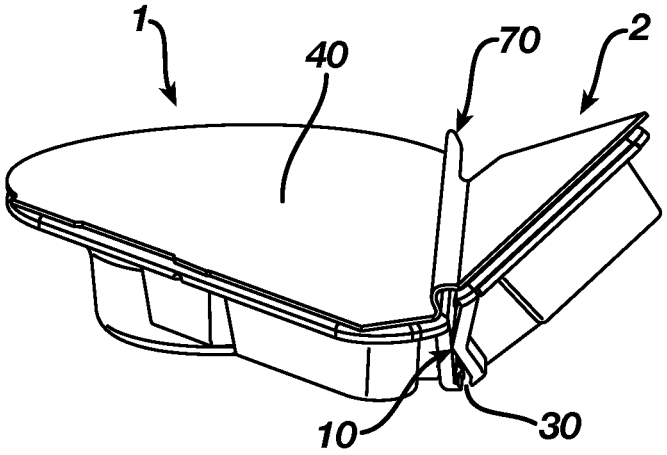
FIG. 7 depicts a package with a grip flexed upward above the plane of the package.

FIG. 7 shows a package of the invention where breakable joint 30 is broken and cover sheet 40 has buckled or crumpled (70). Once the breakable joint 30 is broken, the second section 2 may be used as a grip (designated as 80) to aid in removal of the cover sheet 40 from at least a portion of the first section 1. In the embodiment of FIG. 7, the separation of second section 2 from first section 1, reveals that first section 1 has a spoon shaped configuration.

Figure 8:
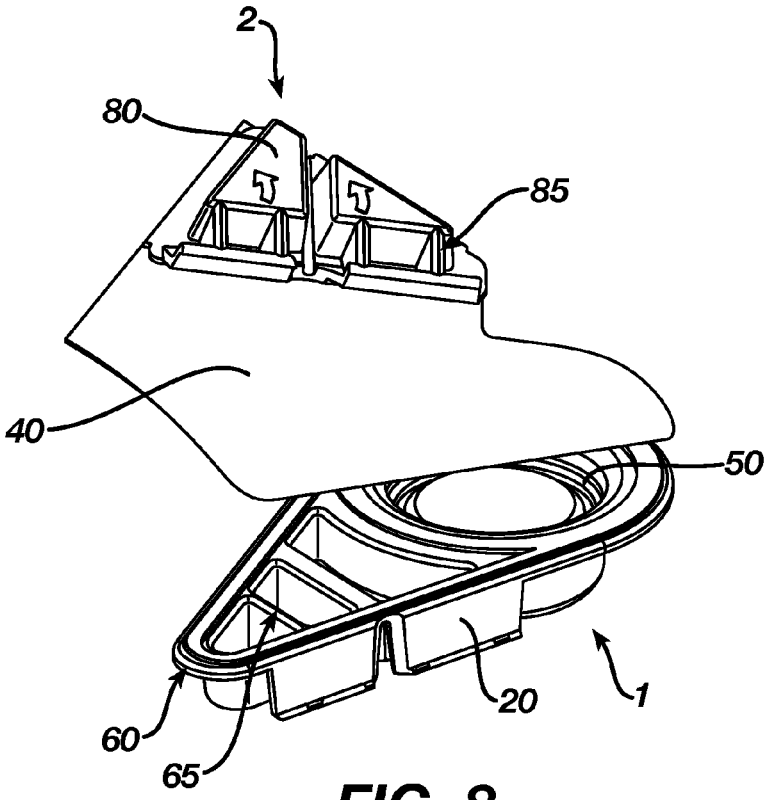
FIG. 8 depicts a package showing the second section detached from the first section.

FIG. 8 shows a package being opened, where the joint has been broken and where grip 80 and cover sheet 40 are being separated from first section 1. As noted above, grip 80 is formed from second section 2 when breakable joint 30 is broken. The resulting configuration of section 1 after removal of section 2 shows a spoon shaped configuration, including a handle 60 and well 50. Optional rib structures 65, 85 may be included in grip 80 and handle 60. The rib structures 65, 85 help strengthen the package. In consumable applications, a spoon shaped package advantageously helps maintain the integrity of a frangible product because it allows the user to consume the product directly out of the package and requires less handling by the user.

Figure 9:
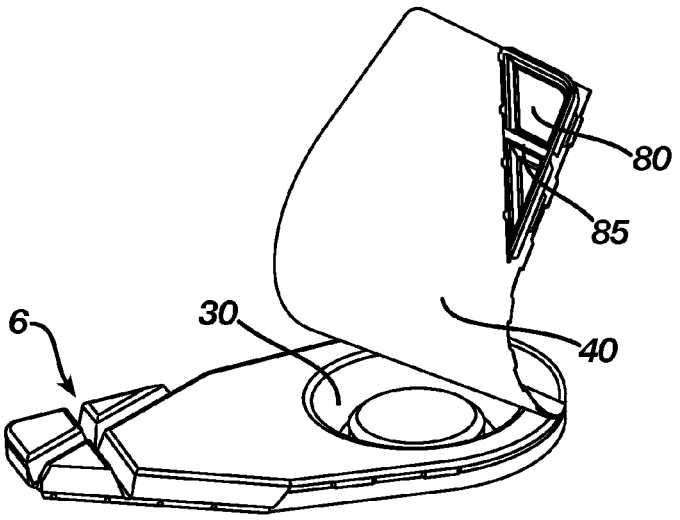
FIG. 9 depicts another embodiment of the invention.

In FIG. 9, an alternative embodiment of an opened package is shown, after breaking the joint and where grip 80 has been separated from the bottom of the package. The grip 80 includes ribs 65. In this embodiment, it can be seen that there is an additional third section 6, in addition to first section 1 and second section 2. This third section 6 may include a breakable joint (not shown) to allow for a right-handed user or a left-handed user to access the well 50, or the third section 6 may be a decoy section that is not breakable.

Figure 10:
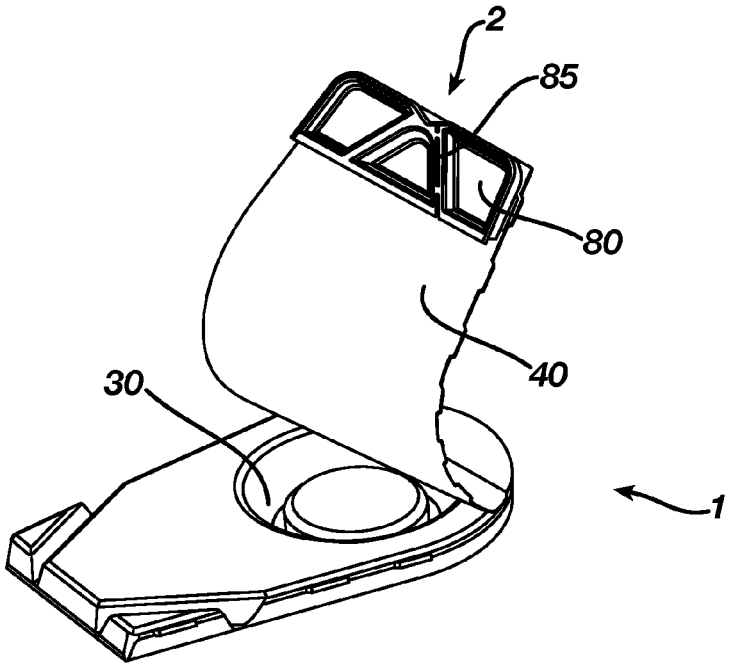
FIG. 10 depicts yet another embodiment of the invention.

FIG. 10 depicts another embodiment of a package with grip 80 and cover sheet 40, where grip 80 and cover sheet 40 are bent in an upward direction above the plane of the package. In this embodiment, it can be seen that section 2 (resulting in grip 80) extends laterally across the sides of section 1. In addition, FIG. 10 shows multiple lines in various directions, which may act as decoy lines which are not breakable by a user.

Notably, the packages shown in FIG. 9 and FIG. 10 have a spoon shape.

Figure 11:
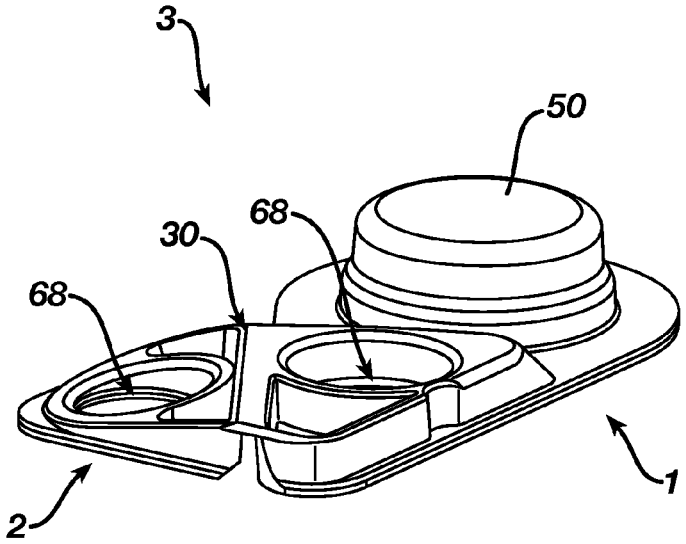
FIG. 11 is a perspective view of a package having openings in the first section and second section.

As can be seen in FIG. 11, an optional feature which may be included in the package is one or more openings 68 formed in the first section 1 and/or the second section 2 of the container. The opening(s) extend through the bottom of the first section 1 and/or second section 2, and expose a surface of the cover sheet, which is adhered to the container.

The openings 68 may provide several beneficial features. In one embodiment, the opening(s) 68 help a user locate thumb and/or finger placement on the package. In another embodiment, the opening(s) 68 may assist in opening the package. For example, an object may be inserted into an opening 68 to break or dislodge the cover sheet, which may then be peeled away to expose the well.

In the embodiment depicted in FIG. 11, second section 2 and handle 60 include openings 68. Openings 68 may be hidden by cover sheet 40. In this particular embodiment, rib structures 65, 85 help to define openings 68 and provide structural strength to container 3, and first section 1 and second section 2 are gradually tapered toward the ends. The openings and the gradual taper are optional ergonomic features which guide the user in how to hold the package for opening.

Figure 12A:
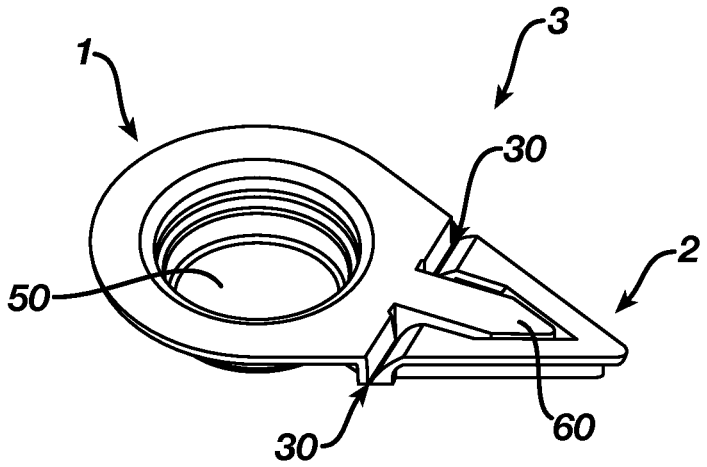
FIG. 12A and FIG. 12B illustrate the pivoting action of an embodiment of a package of the invention.
Figure 12B:
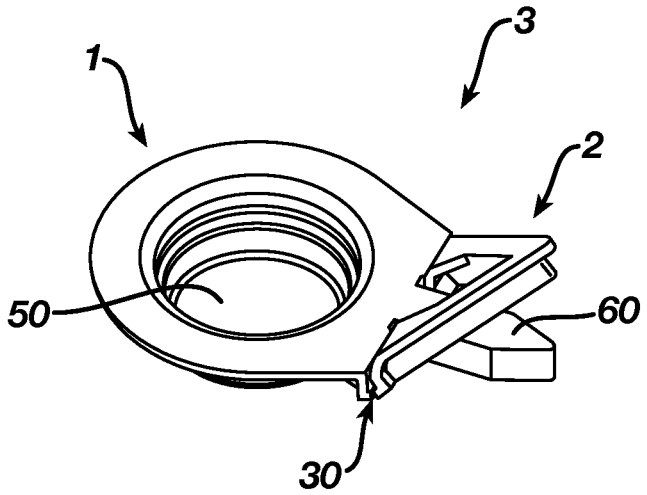

In FIGS. 12A-12B, an optional configuration for a package is shown. In this embodiment, container 3 is shown with first section 1 and second section 2. First section lincludes well 50 and handle 60. Two breakable joints 30 connect first section 1 to second section 2. It can be seen that handle 60 extends beyond the plane of the breakable joint 30. Second section 2 surrounds a portion of the handle 60. In FIG. 12B, second section 2 has been bent upward to break breakable joints 30, thereby separating second section 2 from first section 1 (of course, if a cover sheet is adhered to first section 1 and the second section 2, the first and second sections may remain attached via cover sheet). Thus, in this embodiment, there are two breakable joints with at least two fulcrums. This embodiment demonstrates that the inventive package may include more than one breakable joint and more than one fulcrum and further demonstrates an embodiment where a portion of the first section 1 (e.g., handle 60) extends beyond the plane of the breakable joint 30.

Figure 13A:
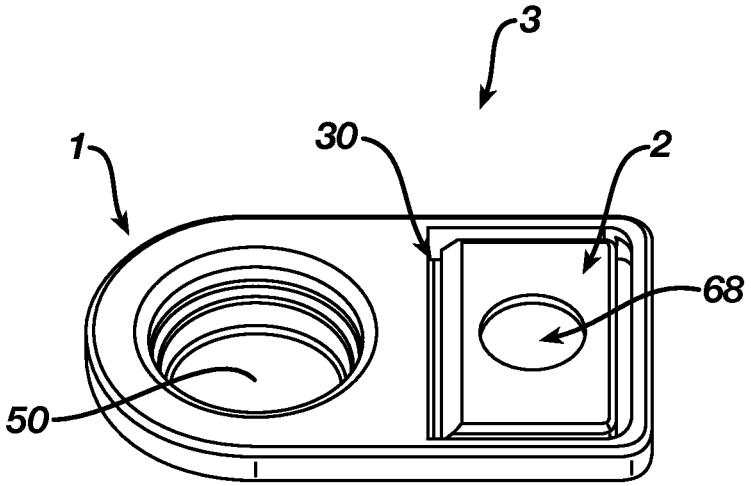
FIG. 13A and FIG. 13B illustrate the pivoting action of an embodiment of a package of the invention.
Figure 13B:
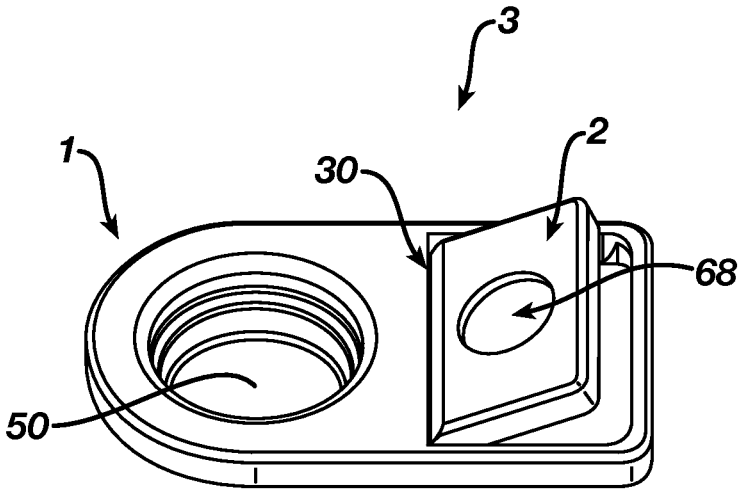

In FIGS. 13A-13B, an alternate embodiment is shown. In this embodiment, the first section 1 completely surrounds the second section 2. That is, the second section 2 is disposed within the periphery of first section 1. In this embodiment, the first section 1 can be considered to cross the plane of breakable joint 30. Opening 68 in second section 2 may be used to locate a thumb or finger placement or to provide the ability to open cover sheet by inserting an object through the opening 68. In FIG. 13B, second section 2 has been bent upward and breaks breakable joint 30. The second section 2 may then be used to pull the cover sheet off of the first section 1 such that the interior of the well 50 is accessible. Handle 60 remains.

Figure 14A:
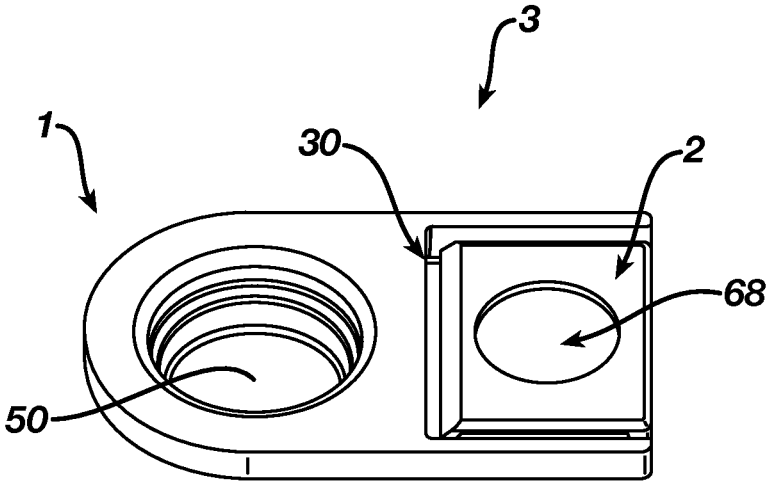
FIG. 14A and FIG. 14B illustrate the pivoting action of an embodiment of a package of the invention.
Figure 14B:
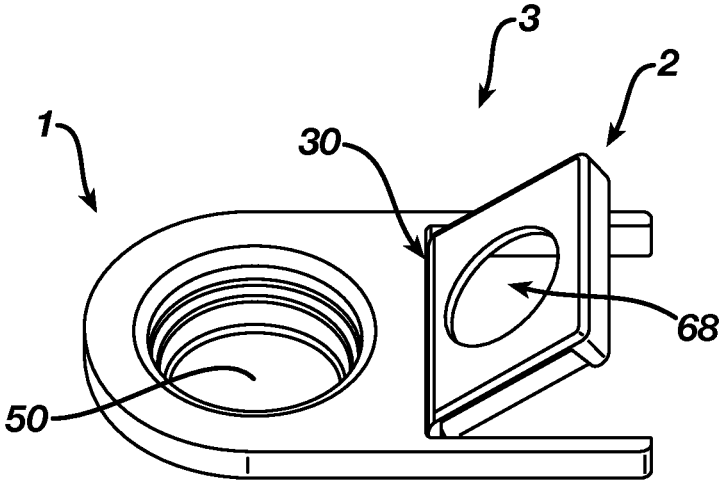

The embodiment shown in FIGS. 14A-14B is similar to the embodiment of FIG. 13A, except that the first section 1 does not completely surround second section 2. Rather, a portion of the first section 1 surrounds a portion of the periphery of second section 2. The first section 1 crosses the plane of breakable joint 30 on two sides. Optional opening 68 in second section 2 may also be used to locate a thumb or finger placement. In FIG. 14A, second section 2 is moved upward and breaks breakable joints 30. The second section 2 may then be used to pull the cover sheet off of the first section 1 such that the interior of the well 50 is accessible. Handle 60 remains.

The second section 2, when separated from the first section 1, may serve as a grip for opening the package. The grip 80 is a three dimensional structure that may remain attached to the cover sheet after breaking the joint, and is used to pull the cover sheet away from the first section to expose the well. As noted above, since the cover sheet 40 is secured to the package in such a fashion that it cannot be peeled away without force acted on the package, severing the joint 30 is necessary to peel away the cover sheet 40. In one embodiment, when the second section 2 is separated from the first section 1 (forming grip 80), the remaining package (first section 1 and optional handle 60) may form/resemble the shape of a spoon.

The grip 80 is made using materials such as, for example, polypropylene, polyethylene, high density polyethylene (HDPE), polyvinyl chloride, polyvinylidene chloride (PVDC), fluorinated-chlorinated resin, fluoropolymer, and mixtures thereof. As with other portions of the package, the grip 80 is desirably made of recyclable material. The grip 80 may be made from the same material as the first section 1 or it may be made from different material.

The grip 80 may be formed having varying thicknesses. In one embodiment, the grip 80 has a thickness different from the thickness of the lip surrounding the well 50.

The grip 80 may also provide structural strength to the package. This may be achieved, for example, by reinforcing the grip 80 by including one or more ribs in the three dimensional structure. It is also preferred that the grip 80 be ergonomically designed (i) for gripping by a thumb and/or finger, and/or (ii) to have a desired texture.

Typically, at least a portion of the cover sheet 40 is also attached to the grip 80. The cover sheet 40 should remain adhered or attached to the grip 80 after separation of the second section 2 and during peeling of the cover sheet 40 from the first section 1. The portion of the cover sheet is removed from the container by separating the grip 80 from the first section 1.

The first section 1 may include a handle 60 that is designed for holding the package after the cover sheet 40 has been removed. Advantageously, the handle 60 is designed to be a three dimensional structure. In one embodiment, the handle 60 is formed having varying thickness. In another embodiment, where the container includes a lip, the thickness of the handle 60 is greater than the thickness of the lip. In yet another embodiment, the handle 60 has a thickness that is less than the thickness of the lip.

The handle 60 may also provide structural strength to the package. This may be achieved, for example, by reinforcing the handle 60 by including one or more ribs. The ribs may beneficially provide stiffness and support to the handle 60. In addition, the ribs may also form or define wells, which may be used to hold product.

Ideally, the handle 60 is shaped ergonomically for gripping by a thumb and finger.

In one embodiment, the handle 60 has a V shape, and in other embodiments, the handle 60 may have a rectangular or irregular shape.

Optionally, a decoy element may be included. A decoy element is a weakened bend line/area (e.g., a trough and/or thinned bend line) of a package that bends up or down or side to side. It is designed to misdirect and/or fool someone who should not have access to the product in the package (e.g., a child) from locating the opening mechanism of the package. The decoy element may be included to provide added child resistance protection to the package. The ability to bend the decoy up and/or down or side to side, creates a distraction for a child so that he or she is less likely to find the proper opening means to the package. Depending upon the degree of opening difficulty desired, more than one decoy element (e.g., bend lines at various angles to each other) may be included in the package.

The weakened area of the decoy element may be formed by many means, including mechanical means such as scoring or notching the container/package, or during molding of the package. In one embodiment, the weakened area of the decoy element is formed as the package is manufactured. Preferably, the decoy element is hidden or camouflaged to make it a non-obvious part of the package. Again, although the decoy is weakened to allow flexing and movement, it is not so weakened so as to break or sever.

Figure 15:
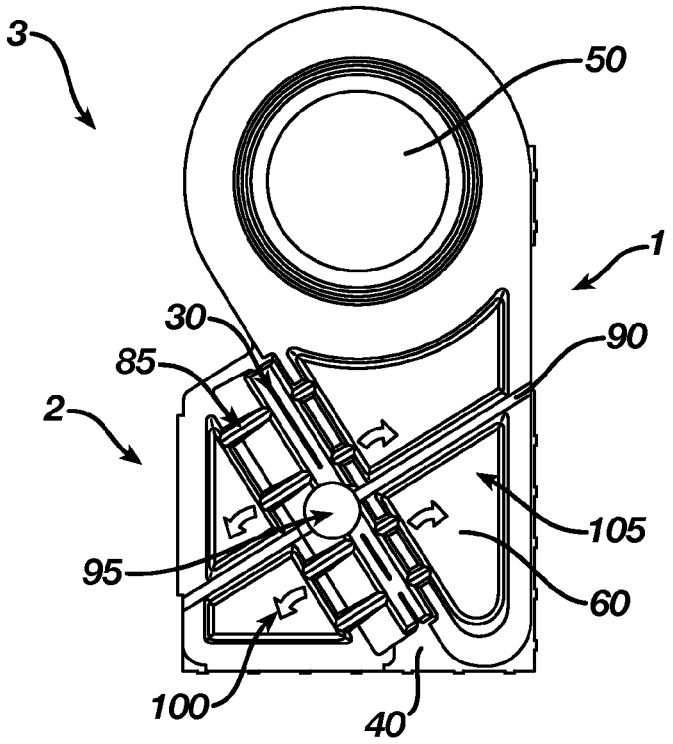
FIG. 15 is a bottom view of a package having a decoy feature of the present invention.
Figure 16:
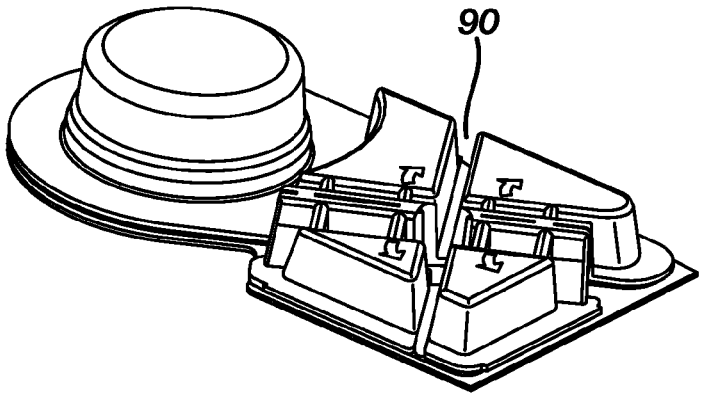
FIG. 16 is a perspective view of the package of FIG. 10.

In FIG. 15, a bottom view of the package with a decoy element 90 is shown, where the decoy 90 is identified along a bendable line. As can be seen in this Figure, first section 1 and second section 2 are still separated by a breakable joint 30. In this embodiment, opening 95 runs across breakable joint 30. Thus, breakable joint 30 is divided in two. Although not seen in this Figure, a cover sheet 40 is attached on the top surfaces of first section 1 and second section 2. In the embodiment shown, the decoy 90 extends across the handle 60 of the first section 1 and across the second section 2. In FIG. 16, a bottom perspective view of the package with a decoy element 90 is shown. Here again, the decoy 90 runs across the handle 60 of the first section 1 and across the second section 2.

Figure 17:
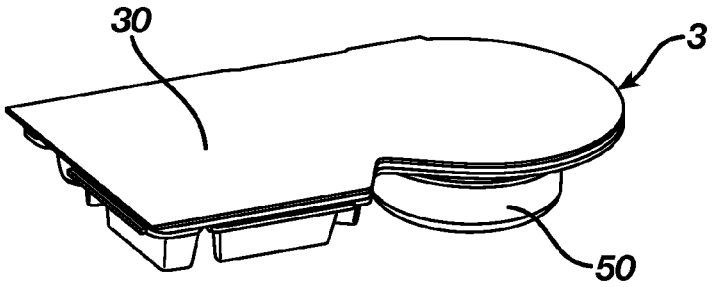
FIG. 17 is a top view of the package of FIG. 10.
Figure 18A:
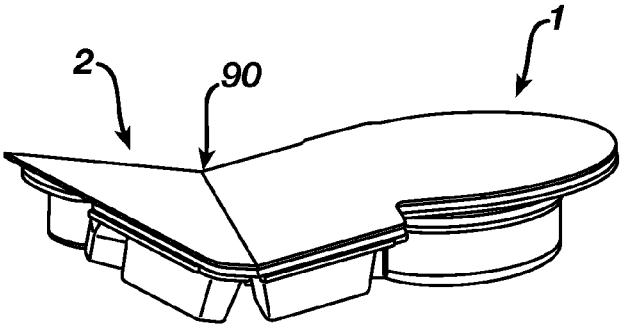
FIG. 18A and FIG. 18B depict a package with a decoy bent in an upward direction and in a downward direction.
Figure 18B:
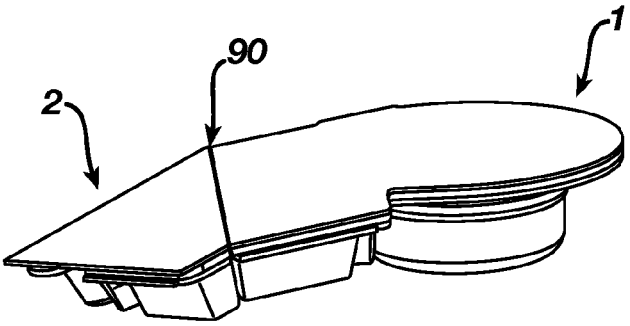

FIG. 17 is a top view of an individual package, where cover sheet 40 covers the container 3. As can be seen, the cover sheet 40 fully covers the well 50 and is at least partially attached to the top surfaces of the first section 1 and second section 2. The cover sheet 40 is attached to the container 3 in such a fashion that a user cannot grab or hold the cover sheet 40 without first separating the sections 1, 2. A decoy 90 enables the package to be bent in an upward and/or downward direction, as exemplified in FIG. 18A and FIG. 18B without breaking or opening the package. As can be seen, when a user attempts to access the well 50 by bending along decoy 90, the second section 2 moves upward (FIG. 18A) or downward (FIG. 18B) without breaking or severing. Although the embodiments shown in the figures show the decoy running across the first section 1 and the second section 2, it should be understood that the decoy may reside in only one section, e.g., the first section 1 or the second section 2.

The package of the invention is designed to have superior strength to protect its contents. For example, the well 50 has a crush strength of at least about 50 lbf. Preferably, at least about 100 lbf., and more preferably, at least about 200 lbf.

Moreover, the container 3 and/or the cover sheet 40 of the package may be constructed using materials that provide moisture barrier properties to the package. In one embodiment, the package is capable of maintaining a moisture barrier when subjected to a temperature of 40° C., 75% relative humidity, for 3 months.

The package may also provide protection from UV light. Selection of translucent or opaque materials to form the package would provide the desired protection for the product. Other desirable characteristics, e.g., stability of the product, may affect the selection of material for forming the package.

The package is well suited to protect a medicament such as, for example, a tablet, a liquid, a powder, a capsule, or combinations thereof. In one embodiment, the medicament is a friable tablet.

In one embodiment, the tablet is prepared such that the tablet is relatively soft (e.g., capable of disintegrating in the mouth or being chewed). The hardness test (crushing hardness) is based on hardness of the dosage form measured perpendicular to the cross-section at the belly band using a modified Model 6d, Pharmatron hardness tester fitted with a 50 g force load cell (lower forces required for testing the invention). Unless otherwise indicated, testing is conducted on two stacked tablets, and the hardness is reported as 50% of the hardness measured. In one embodiment, the hardness of the tablet is less than 5 kiloponds, such as less than 0.5 kiloponds.

In another embodiment, the density of the tablet is at least about 0.6 g/cc. In yet another embodiment, the density of the tablet is less than about 1.5 g/cc. In still yet another embodiment, the bulk density of the lossy coated particles is from about 0.5 g/cc to about 1 g/cc.

In one embodiment, the tablets have a friability of less than 10 percent, such as less than 5 percent, such as less than 3 percent. As used herein, "friability" is measured using the USP 24 NF 29 Tablet Friability (Section 1216) with the modification of using 3 tablets for 15 rotations or 3 tablets for 100 revolutions (unless otherwise noted) instead of 10 tablets for 100 rotations.

One aspect of the present invention is the use of graphics or indicia to provide instructions to a user or consumer as to how to open the package. The graphics may be included on the cover sheet 40 and/or the container 3. This may be helpful to seniors and/or individuals who speak a different language, as the image provides a graphic with little or no words.

Figure 22:
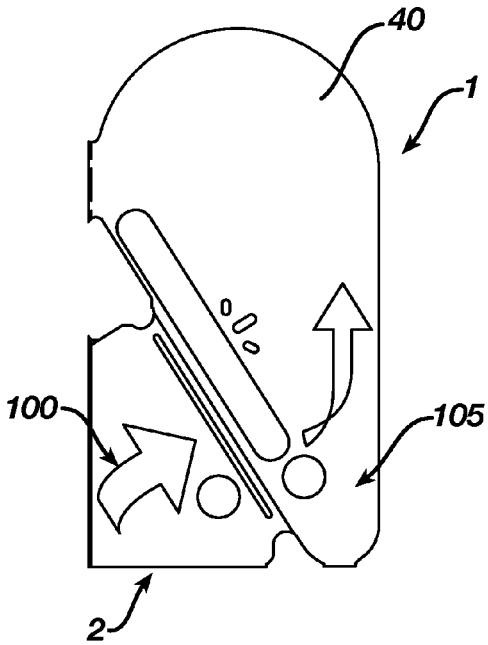
FIG. 22 depicts a cover sheet with 3-dimensional graphics and text.

In FIG. 22, a top view of a package is shown, where cover sheet 40 has a three dimensional graphical image 100 (e.g., block arrow) and text 105. In the embodiment shown, the three dimensional graphical image 100 is a block arrow which communicates the direction that second section 2 should be bent to open the package. Two graphical images 100 may be used, showing the user to first bend the second section 2 along joint 30, and then peel the cover sheet 40 using resulting grip 80.

In this particular embodiment, the three dimensional image 100 is directly placed on the area of opening of the package. However, it should be understood that the three dimensional image may be placed anywhere on the package. Alternatively, the image may be formed on the container as the container is molded. Or, the graphical image may be embossed or debossed on the surface of the cover sheet to draw the user's attention to the graphical image. Decoy images may be used to distract or fool users, if desired.

To assist in creating the three dimensional effect of the image, a color or colors may be used. Color shading and highlighting may also help create the three dimensional image. The image may be photorealistic. For example, color shadows and highlights may be used to create a photorealistic image depicting how the package is opened.

In addition, the three dimensional image may be used to show an area of weakness in the package. Or it may be used to show an area of the package which bends to open the package. For example, the image may be used to communicate to a user the direction to bend a tab on the package. This may be accomplished by including a block arrow showing the direction to bend the first section and/or second section on the package. In a particular embodiment, as the package is opened, the three dimensional image is separated from the package.

Figure 23:
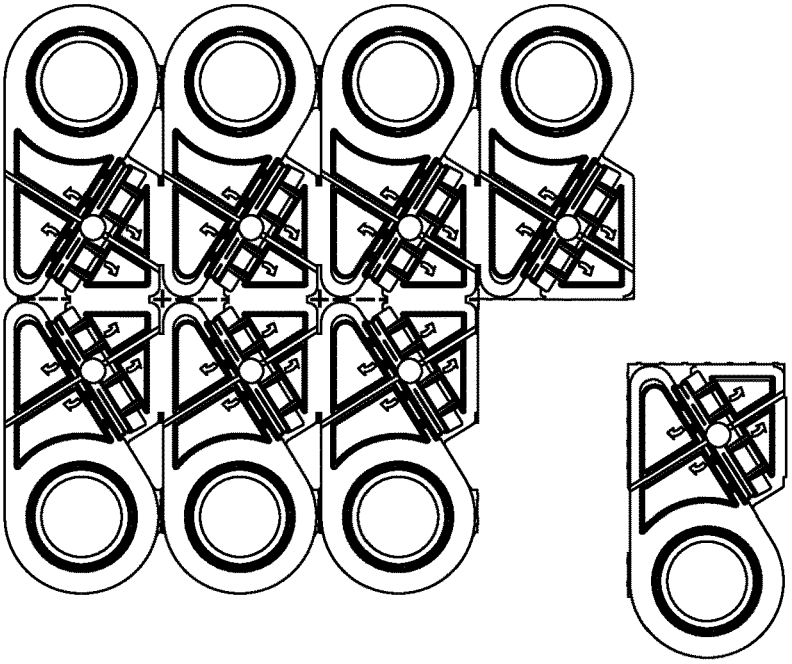
FIG. 23 is a bottom view of a card having eight individual packages, wherein one package has been separated from the card.

FIG. 23 is a bottom view of a card having eight individual containers 3 in a 2 by 4 configuration, wherein one container 3 has been separated from the card. Each container 3 in this embodiment has a first section 1 and second section 2, each separated by a breakable joint 30, a well 50, a handle 60, a grip 80 and a decoy 90. Although not seen in FIG. 23, a cover sheet 40 is disposed on the top surface of each container 3. During molding, a graphical image 100 and text 105 may be molded into the package, which provides instructions to a user. Each container 3 is secured to adjacent containers 3 in a removable fashion, such that a user may easily separate one container 3 from another 3, without breaking the joint 30 or peeling the cover sheet 40.

Figure 24:
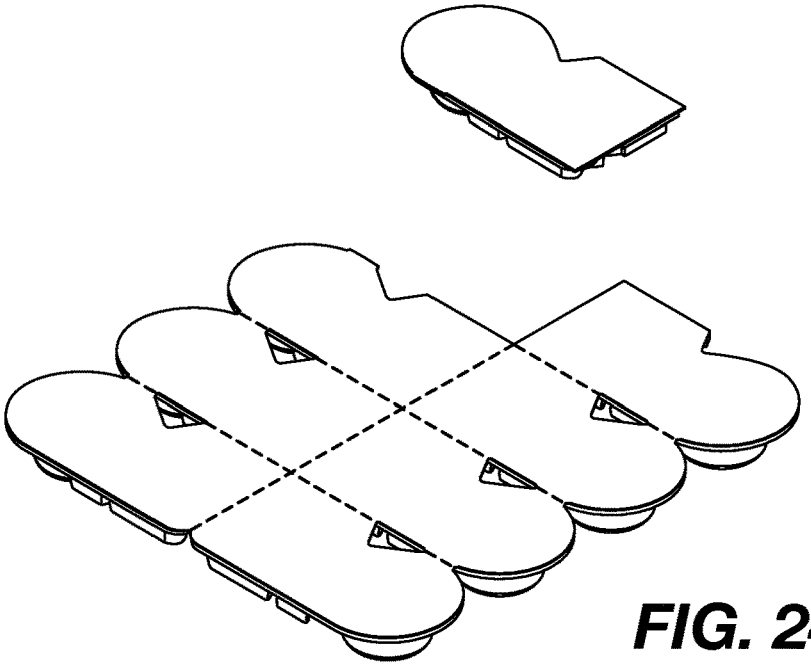
FIG. 24 is a top view of a card having eight individual packages, wherein one package has been separated from the card.

FIG. 24 is a top view of the card of FIG. 23, having eight individual containers 3, wherein one container 3 has been separated from the card. Each container 3 includes a cover sheet 40 covering the first and second sections (1, 2), the joint 30, a well 50, a handle 60, a grip 80 and a decoy 90.

The inventive package is well suited to protect a medicament such as, for example, a tablet, a liquid, a powder, a capsule, or combinations thereof. In one embodiment, the medicament is a friable tablet.

In one embodiment, the package is used to dispense a unit dose of a medicament. The dosing of drugs benefit from the package design by enclosing an individual dose in the package. User compliance is improved by printing instructions on the individual package for each dose.

If used, the card is configured with at least 2 packages. More preferably, the card has at least 6 packages. Even more preferably, the card has at least 8 packages. The card provides another degree of child resistance by adding an additional step, which requires separating an individual package from the other packages in the card.

The package or card may be manufactured using a variety of means. For example, the package may be made by a molding process such as injection molding, bi-injection molding, compression molding, thermoform molding, cast molding, or any other molding process. Moreover, the package may be formed using 3-dimensional printing methods. Ideally, the package is made by injection molding, where a container is formed from a semi-plastic material.

After the container is formed, a product is placed in the well. The cover sheet may then be placed over at least a portion of the container to cover the well and seal the product within the well and container. The cover sheet desirably covers at least a portion of the first section 1 and second section 2. The container and the cover sheet may be joined together by any sealing method known in the art that adequately seals a product within the well. For instance, if the product has a low stability or shelf-life such that an air-tight seal is necessary, then the materials of the container and the cover sheet and the sealing method are selected to achieve an air-tight seal around the well. Sealing methods that may be used, for example, include heat sealing, adhesive seals (such as with heat-activated or solvent adhesive), RF or sonic seals, or any other suitable means. The materials of the container and the cover sheet may be pre-treated to facilitate sealing of such materials together. For example, a coating may be applied to the container and/or the cover sheet to permit heat sealing.

The breakable joint and optional decoy may be formed to have the desired resistance during molding or alternatively, the breakable joint and optional decoy may be scored or notched after the container is formed. The weakening of the joint and optional decoy may be formed at any desired stage of forming the package. For example, the package may be passed through equipment designed to form the desired type of weakenings once the well has been filled and the container and the cover sheet are sealed together. Once the package or card has been formed with its desired child-resistant features, it may be passed through die-cutting equipment for separation.

The card may be made using the same materials described above for the package.

Alternatively, the present invention may include a package comprising a first section and a second section connected at a breakable joint, wherein either the first section or the second section is adapted to pivot at a fulcrum between the first section and the second section to assist in breaking the breakable joint in order to separate at least a portion of the first section from at least a portion of the second section, such that upon the breaking, the package is opened or allows access to an opening feature, wherein the breakable joint is capable of bending/moving prior to breaking.

In another alternative embodiment, the present invention is a package comprising a plastic container having a first section and a second section connected at a breakable joint, wherein the first section comprises a well, a handle, and a cover sheet, wherein the cover sheet is adhered to at least a portion of the first section and the cover sheet covers the well; wherein either the first section or the second section is adapted to pivot at a fulcrum between the cover sheet and the joint to assist in breaking the breakable joint in order to separate the first section and the second section, such that upon the breaking, the package remaining has the shape of a spoon.

As should be appreciated from the foregoing, a package formed in accordance with the principles of the present invention is simple in construction, can be made economically and relatively simply, provides a protective environment for products, and can be readily opened without the use of utensils, such as scissors or knives, but cannot readily be opened by children.

Example 1

A package is manufactured in accordance with the invention, where a medicament is placed inside the well of the package. The package includes 3-dimensional graphics to show how to open the package. The package does not include a decoy. A study is performed using the package where children and adults are given the package and asked to open the package. The study finds that at least about 80% of children aged 3.5 to 4 years cannot open the package and greater than about 90% of adults aged 65-70 are able to open the package.

Example 2

Package Tension Testing

Testing was performed to characterize the force required to remove the breakable/removable second section (e.g., tab) from the first section. Testing did not employ movement of section two such that the fulcrum was utilized. Rather, section two was pulled perpendicular to the fold line in a 180 degree manner. Testing was performed on a Chatillon LR5K tension/compression tester with a crosshead speed of 0.500 inches/minute, using the procedure detailed below.

Procedure:

1. Scissors are used to cut along the perforations to separate package units in a multi-unit package into individual units.
2. Scissors are used to remove the product containing well from the remaining portion of the package containing the opening feature.

Note: This step was performed so that the clamps can sufficiently grab the test sample without the well being an obstruction.

3. A knife (e.g., Exacto, utility), is used to cut the lidding material that is located behind the opening feature. Care is used to avoid marring the package.

Note: This step is performed for the following reasons:

The samples being tested have been sealed with a lidding material such that they are representative of a finished package.

The lidding material is being cut such that the tensile strength of the lidding material is not part of the test.

4. The space between the bottom of the upper clamp and the top of the lower clamps is set to be approximately 7/16" (0.4375" inches).
5. The removable second section (referred to as a tab hereafter) is located in the upper clamp. The lidding side of the package is located on the movable side of the clamp.
6. The remaining portion of the package is located in the lower clamp.

Note: The sample is positioned in the following manner.

7. The opening feature is set parallel with the top of the lower clamp and bottom of the upper clamp.
8. The opening feature is set centered within the upper and lower clamps; i.e., so there is equal space on either side of the opening feature, to the left and right outside edges of the upper and lower clamps.
9. The clamps are sufficiently tightened such that the sample does not slip during testing.
10. The load cell is set to a sufficient capacity such that the force required to separate the tab from the first section can be quantified.

Notes: A 500 Newton load cell was used.

Test speed is configured at 0.500 inches per minute.

Displacement is set at a distance that is sufficient to capture the peak force.

The displacement was set at 0.1500 inches.

The test is set in a tension mode such that the upper and lower clamps move away from each other.

11. Once the sample is loaded, the load is zeroed.
12. The Test is executed.

Note: The upper and lower clamps move away from each other such that the force required to separate the second section from the first section is quantified.

13. After the test is completed, the test sample is removed and the upper and lower clamps are repositioned to their original positions.
14. The process is repeated as needed until all intended samples are tested.

The average force required to separate section two from section one was determined to be 13.21 lbf.

Example 3

Package Well/Cavity Compression Testing

Compression testing of the package well/cavity was tested against well/cavity compressive resistance of thermoformed cavities.

Procedure:

1. Scissors are used to cut along the perforations to separate package units in a multi-unit package into individual units.
2. A bottom fixture is used as an immovable rigid platform.
3. A cylinder is used as an upper fixture with a diameter large enough to encompass the product containing area of the package.
4. The space between the upper and lower fixture is set to accommodate the test package height without compressing the test package or having an unnecessary gap (i.e., the test package could be changed with just enough space to not drag on the upper fixture).
5. A load cell of a sufficient capacity, such that the force required to compress the cavity to 50% of its original height could be quantified, is used.

Note: A 500 Newton load cell was used for sample packages 1-5.

A 5 Kilonewton load cell was used for sample package 6 (the injection molded package).

Test speed was configured to 0.500 inches per minute.

Displacement was set at a distance that was a minimum of 50 percent of the original package height.

Package heights were determined by either looking at the approved package drawing or by taking measurements.

6. The test was set to compression mode, so that the upper fixture moved towards the lower fixture.
7. Once the sample is centered under the upper fixture, the load is zeroed.
8. The test is executed.

Note: The upper and lower fixtures move towards each other such that the force required to compress the well/cavity to a minimum of 50% of its original height is quantified.

9. After the test is complete, the tested sample is removed and the upper and lower clamps are repositioned to the original positions.
10. The process is repeated as needed until all intended samples are tested.

The following table summarizes the forces required to compress the thermoformed cavities and the injection molded polypropylene (PP) package of the invention. As noted in the procedure above, the wells/cavities were compressed to 50% of their original height. This compressive level was used as it is probable that product damage (to some degree) would occur by that point. The wells/cavities being tested were all sealed with a cover sheet (foil lidding material) and the cavities were all empty. Testing was performed on a Chatillon LR5K tension/compression tester with a crosshead speed of 0.500 inches/minute. Table 1 below shows the results of such testing.

TABLE 1

| Sample | Design | Avg. LBF | Load Cell |
|---|---|---|---|
| 1 | Cold Form Foil Cavity | 11.50 | 500 Newton |
| 2 | Aclar 160/02 Small Single Cavity | 15.35 | 500 Newton |
| 3 | Aclar 160/02 Large Single Cavity | 16.52 | 500 Newton |
| 4 | Aclar 160/02 Small Double Cavity | 30.22 | 500 Newton |
| 5 | Aclar 160/02 Large Double Cavity | 36.55 | 500 Newton |
| 6 | PP Injection Molded Package | 204.4 | 5 Kilonewton |

Example 4

Table 2 below summarizes the Water Vapor Transmission Rate (WVTR) data that characterizes the polypropylene (PP) injection molded package's barrier properties. The packages were sealed with a cover sheet made of foil lidding material. Individual wells were tested using Mocon Permatran-W 3/33 test equipment and methodology.

Procedure

1. Samples representative of a final package form were identified; i.e., formed wells/cavities and sealed with a foil lidding.

Note: (1) The foil lidding material was consistent with standard lidding material available in the industry.

(2) The sealing process for adhering the foil lidding to the formed material was consistent with standard sealing processes available within the industry (e.g., seal plate).

2. Distilled water was drawn into a hypodermic needle.

3. The hypodermic needle was inserted through the lidding material such that 0.1 mL of water could be injected into the product containing well/cavity of the package.

4. The hypodermic needle was removed from the package taking care that the lidding material stayed dry and the remaining hole was sealed with a quick set epoxy.

5. Samples were given a sufficient time such that the quick set epoxy could dry.

6. Once dry, samples were loaded into the package test cells and affixed to the Mocon Permatran-W 3/33 test equipment.

7. The package testing cells were secured to the equipment via the Permatran-W 3/33 U-bolt.

8. The appropriate calibration was loaded.

Note: The appropriate calibration is one for a high barrier package having a low permeation rate.

9. Test dwell was set for a duration appropriate for the calibration being used.

Note: A two hour dwell was selected based on the calibration being used.

10. The "Convergence Period" was set at "4".

Note: "Convergence Period" is a setting within the software for defining the completion of testing. This relates to the package being at a steady state permeation rate.

11. Testing was started and continued until the Convergence Criteria was met.

12. Data was printed.

13. The U-bolt was loosened and repositioned such that the package test cells could be removed and the test packages removed.

14. The process of loading new test samples within the package test cells, securing to the Mocon Permatran-W 3/33, and starting the test was repeated until all test samples were tested.

TABLE 2

| Study Number | Seal Temp. | Average WVTR |
|---|---|---|
| 1 | 210° C. | 0.07 mg/pkg/day @ 23.0 C., 75% R.h. |
| 2 | 210° C. | 0.06 mg/pkg/day @ 23.0 C., 75% R.h. |

While the invention has been described above with reference to specific embodiments and illustrated in drawings of specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A package comprising:

a container having a first section and a second section connected at a breakable joint, wherein the first section comprises a well; and a cover sheet, wherein the cover sheet is adhered to at least a portion of the first section and at least a portion of the second section and the cover sheet covers the well;

wherein either the first section or the second section is adapted to pivot at a fulcrum between the cover sheet and the joint to assist in breaking of the breakable joint in order to separate the first section and the second section, such that upon the breaking, the first section and the second section are still adhered to the cover sheet and wherein the second section serves as a grip to remove the sheet from the first section to expose the well.

2. The package of claim 1, wherein a portion of the first section extends beyond the plane of the breakable joint to be at least partially surrounded by the second section.

3. The package of claim 1, wherein a portion of the second section extends beyond the plane of the breakable joint to at least partially surround the first section.

4. The package of claim 1, wherein the container is an injection molded container.

5. The package of claim 1, wherein the container is made of a plastic material selected from the group consisting of polypropylene, polyethylene, high density polyethylene (HDPE), polyvinyl chloride, polyvinylidene chloride (PVDC), fluorinated-chlorinated resin, fluoropolymer, and mixtures thereof.

6. The package of claim 1, wherein the package further comprises a decoy that is adapted to bend.

7. The package of claim 1, wherein the cover sheet includes a 3-dimensional graphic showing how to break the joint.

8. The package of claim 1, wherein at least about 80% of children aged 3.5 to 4 years cannot open the package and greater than about 90% of adults aged 65-70 are able to open the package.

9. The package of claim 1, wherein the first section or the second section comprises an opening exposing a bottom surface of the cover sheet.

10. The package of claim 1, wherein the well has a crush strength of at least 50 lbf.

11. The package of claim 1, wherein a majority of the side wall of the well is at an angle from about 0° to about 20° as measured by a plane perpendicular to the cover sheet.

12. The package of claim 1, wherein the well has a side wall and a bottom, where the bottom of the well has a thickness that is greater than the thickness of the side wall.

13. The package of claim 1, the well has a side wall, wherein the thickness of the bottom of the well is greater than 80% of the thickness of the side wall.

14. The package of claim 1, wherein a lever ratio defined by the distance from the fulcrum to a distal point of the breakable joint Compered to the length of a lever defined by the first section or the second section is at least about 1:1.

15. The package of claim 1, wherein the breakable joint breaks as the second section is moved in a rotational direction toward the first section or the first section is moved in a rotational direction toward the second section.

16. The package of claim 1, wherein the first section further comprises a handle portion for holding the at least one well.

17. The package of claim 1, wherein the well holds a medicament.

18. A card comprising at least one package, wherein the package comprises a container and a cover sheet, the container having a first section and a second section connected at a breakable joint, wherein the first section comprises a well; wherein the cover sheet is adhered to at least a portion of the first section and at least a portion of the second section and the cover sheet covers the well; wherein either the first section or the second section is adapted to pivot at a fulcrum between the cover sheet and the joint to assist in breaking the breakable joint in order to separate the first section and the second section, such that upon the breaking, the first section and the second section are still adhered to the cover sheet and wherein the second section serves as a grip to remove the sheet from the first section to expose the well.

19. The card of claim 18, wherein the card is formed by injection molding.

20. The card of claim 19, wherein the card is made of a plastic material selected from the group consisting of polypropylene, polyethylene, high density polyethylene (HDPE), polyvinyl chloride, polyvinylidene chloride (PVDC), fluorinated-chlorinated resin, fluoropolymer, and mixtures thereof.

* * * * *